United States Patent [19]

Shimomura et al.

[11] Patent Number: 4,879,983

[45] Date of Patent: Nov. 14, 1989

[54] APPARATUS FOR CONTROLLING NUMBER OF ROTATION OF INTERNAL COMBUSTION ENGINE

[75] Inventors: Setsuhiro Shimomura; Yukinobu Nishimura, both of Himeji, Japan

[73] Assignee: Mitsubishi Denki Kabushiki Kaisha, Tokyo, Japan

[21] Appl. No.: 196,118

[22] PCT Filed: Jul. 11, 1987

[86] PCT No.: PCT/JP87/00499

§ 371 Date: Mar. 14, 1988

§ 102(e) Date: Mar. 14, 1988

[87] PCT Pub. No.: WO88/00647

PCT Pub. Date: Jan. 28, 1988

[30] Foreign Application Priority Data

Jul. 14, 1986 [JP] Japan ..... 61-166196

[51] Int. Cl.[4] ..... F02D 41/16

[52] U.S. Cl. ..... 123/339; 123/352

[58] Field of Search ..... 123/339, 340, 341, 352, 123/585, 587

[56] References Cited

U.S. PATENT DOCUMENTS 4,603,668 8/1986 Ueno ..... 123/339 X 4,665,871 5/1987 Shimomura et al. ..... 123/352

4,667,632 5/1987 Shimomura et al. ..... 123/339

4,672,934 6/1987 Peter et al. ..... 123/339

4,691,675 9/1987 Iwaki ..... 123/352 X 4,785,780 11/1988 Kawai ..... 123/339

FOREIGN PATENT DOCUMENTS 0002834 1/1976 Japan .

0049347 3/1984 Japan .

0120750 7/1984 Japan .

59-162340 9/1984 Japan .

*Primary Examiner*—Willis R. Wolfe

*Attorney, Agent, or Firm*—Burns, Doane, Swecker & Mathis

[57] ABSTRACT

A apparatus for controlling the number of the rotation of an internal combustion engine, which is capable of feeding air-suction quantity back to the objective value and provided with memory storing and retaining the feedback value when the feedback operation is stopped. When faster adjustment is needed at the moment of resuming the feedback operation or performance characteristic of the air-suction control system largely varies during service period, the apparatus securely retains the feed-back value and applies it as the initial value to allow the engine to securely reactivate satisfactory startup operation.

2 Claims, 1 Drawing Sheet

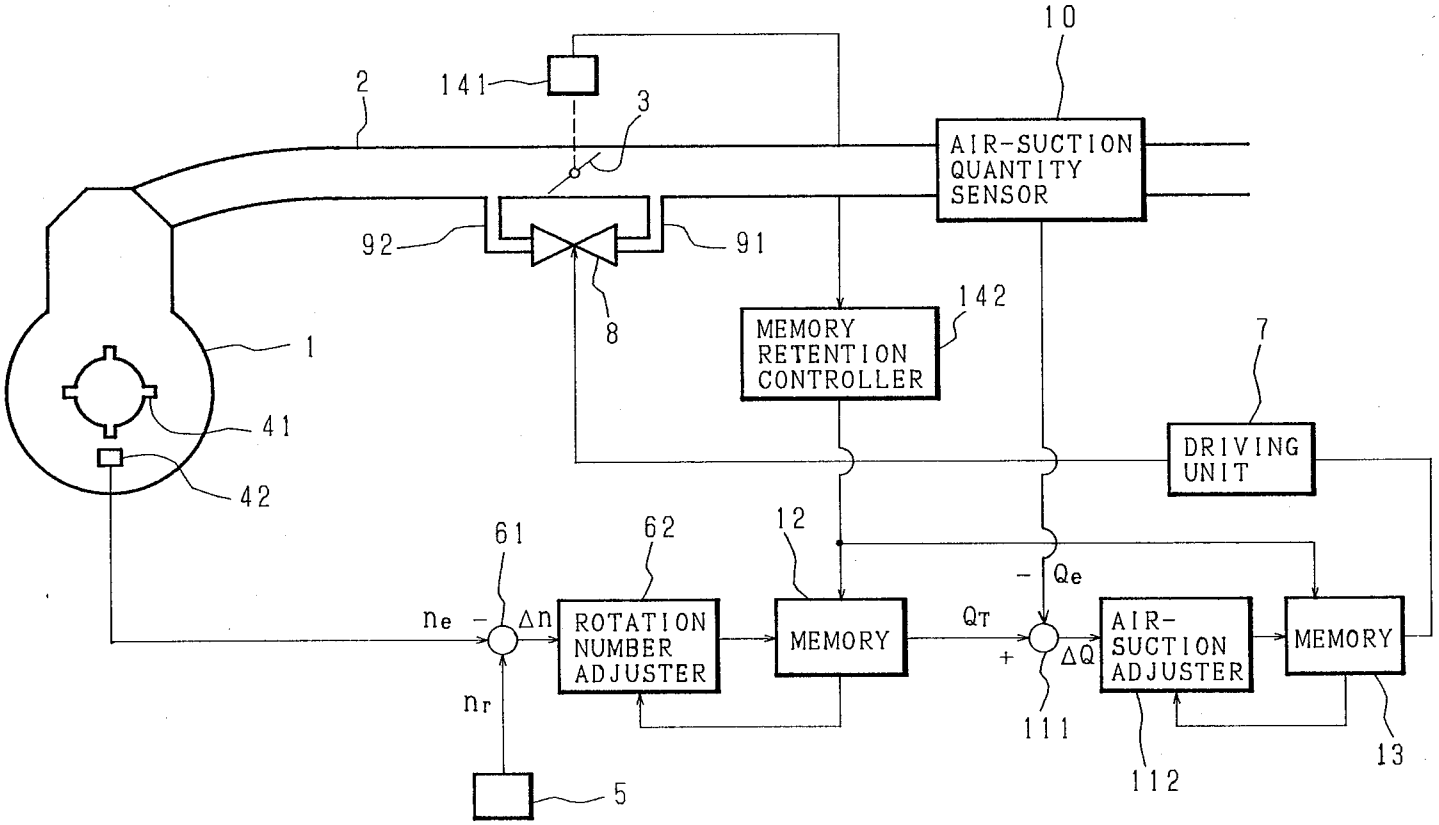
AIR-SUCTION QUANTITY SENSOR
10
DRIVING UNIT
7
MEMORY
13
AIR-SUCTION ADJUSTER
112
Qe
ΔQ
111
QT
142
MEMORY RETENTION CONTROLLER
MEMORY
12
91
3
8
62
ROTATION NUMBER ADJUSTER
5
141
Δn
61
ne
nr
92
2
1
41
42

APPARATUS FOR CONTROLLING NUMBER OF ROTATION OF INTERNAL COMBUSTION ENGINE

FIELD OF THE INVENTION

The present invention relates to a apparatus for controlling the number of the rotation of an internal combustion engine, which feeds the number of non-loaded rotation of an internal combustion engine back to the predetermined number of the rotation.

PRIOR ART

Conventionally, the number of non-loaded rotation of any internal combustion engine has been controlled in order that it can be fed back to the predetermined number of the rotation. The object of controlling the number of non-loaded rotation of the internal combustion engine is to set the number of non-loaded rotation for minimizing fuel consumption during non-loaded operation and also suppress variation of the number of the rotation caused by external disturbance. In either of these cases, it is essential that control be executed very quickly and precisely.

Roughly speaking, two main factors cause the number of the rotation of any engine to vary, which can be classified into the primary factor caused by variation of the loss of non-load of the engine itself or by variation of thermal efficiency of the engine and the secondary factor caused by either the variation of the adjustment gain present in airsuction adjusting means which adjusts the varied number of the rotation caused by the primary factor or by variation of the atmospheric density substantially making up the supply source of fresh air.

To compensate for those variable factors, as proposed by the Japanese Patent Laid-Open No. 59-162340 (1984), there is a specific technique for controlling the number of the rotation of an internal combustion engine, which first generates the objective air-suction volume or the objective air-suction tube pressure in response to the adjustment signal in accordance with the deviation between the objective value and the actual value of the number of the rotation of the internal combustion engine, followed by control of airsuction adjustment means in response to the adjustment signal in accordance with the deviation between the objective air-suction quantity or the objective air-suction tube pressure and the actual air-suction quantity or the actual airsuction tube pressure.

According to this prior art, since the adjustment signal (the signal which adjusts the number of the rotation of the internal combustion engine) is activated in accordance with the deviation between the objective and actual values of the number of the rotation in conjunction with the primary factor of the variable rotations mentioned above and the other adjustment signal (signal which adjusts air-suction quantity) is also activated in accordance with the objective and actual values of the air-suction quantity or the internal pressure of the air-suction tube in conjunction with the secondary factor of the variable rotations mentioned above, it is obvious clear that the variation of the rotation of the engine can precisely and quickly be adjusted rather than applying feedback control using only the number of the rotation.

Since those primary and secondary factors respectively render considerable influence including substantial variation of characteristic during a certain period of time, those adjustment signals extensively adjust the number of the rotation of the engine and the air-suction quantity as well. This in turn obliges the control system to spend much time before allowing the adjustment signal to adjust the number of the rotation from the initial value to the final value, thus eventually obstructing the initial object from properly controlling the number of the rotation of the engine being operated.

Furthermore, in an extreme case, the engine may not be activated at all due to shortage of fresh air being supplied. If this occurs, improvement of the engine condition can not be expected because the operation of the engine rotation-number control starts.

The primary object of the present invention is to overcome those problems mentioned above by providing a novel apparatus for controlling the number of the rotation of an internal combustion engine, which can constantly generate stable and satisfactory number of the rotation.

DISCLOSURE OF THE INVENTION

The apparatus for controlling the number of the rotation of an internal combustion engine related to the invention provides means for retaining the rotation-number adjustment signal and the air-suction adjustment signal even when stopping the control of the number of the rotation of the engine so that these signals can correctly reflect to the initial value when the system enters into the following operation for controlling the number of the rotation.

According to the invention, both the rotation-number adjustment signal and the air-suction adjustment signal are securely retained even when the control of the number of the rotation of the engine is stopped. Both of these signals are used for making up the initial values when the system enters into the following operation for controlling the number of the rotation of the engine being activated.

The number of the rotation of the internal combustion engine is properly controlled so that it can be held at the objective value immediately after the engine is activated or the operation for controlling the number of the rotation of the engine is resumed.

BRIEF DESCRIPTION OF THE DRAWING

The accompanying drawing denotes the simplified block diagram of a preferred embodiment of the apparatus for controlling the number of the rotation of an internal combustion engine related to the invention.

OPTIMUM CONSTITUTION FOR EMBODYING THE INVENTION

Referring now more particularly to the accompanying drawing, a preferred embodiment of the apparatus for controlling the number of the rotation of an internal combustion engine related to the invention is described below. The accompanying drawing denotes the simplified block diagram of a preferred embodiment of the apparatus related to the invention. The reference numeral 1 denotes an internal combustion engine. The reference numeral 2 denotes the air-suction tube which is internally provided with throttle valve 3 for controlling the number of the engine rotation in response to load.

The air-suction tube 2 is provided with a pair of bypasses 91 and 92 in the front and rear portions of the throttle valve 3. Air-section control valve 8 is provided between those bypasses 91 and 92. The air-suction valve 8 is comprised of either a linear solenoid valve or a DC-motor control valve, while either of these is driven and controlled by the power voltage outputted from the driving unit 7.

On the other hand, gear 41 which is interrelated to the rotation of the internal combustion engine 1 is provided inside of this engine 1. Sensor 42 detects the number of the rotation of gear 41 and outputs the engine rotation number signal $n_e$ to differential amplifier 61.

The differential amplifier 61 also receives the objective rotation-number signal $n_r$ from the objective rotation-number generator 5 which generates the objective rotation-number signal $n_r$ indicating the objective non-loaded rotation number in response to various conditions of the engine and temperature for example.

The differential amplifier 61 computes error $\Delta n$ between the objective rotation-number $n_r$ and the engine rotation-number signal $n_e$ output from the rotation-number sensor 42 and then outputs the error $\Delta n$ to the rotation-number adjuster 62.

On receipt of the error $\Delta n$, the rotation-number adjuster 62 generates the rotation-number adjusting signal in the direction of canceling the error $\Delta n$ by executing either proportional, integral, or differential operation before delivering the result to memory 12, which then outputs the objective air-suction value QT relates to the engine 1 to the other differential amplifier 111. The differential amplifier 111 also receives signal Qe from the air-suction quantity sensor 10 which is provided inside of the air-suction tube 2 and detects the quantity of air absorbed into the internal combustion engine 1 via the air-suction tube 2.

In addition, the differential amplifier 111 outputs signal Qe received by the air-suction quantity sensor 10 and signals received by memory 12, i.e., the error $\Delta Q$ against the objective air-suction quantity QT, to the air-suction adjuster 112. On receipt of this error $\Delta Q$, the air-suction adjuster 112 generates the air-suction adjusting signal in the direction of canceling the error $\Delta Q$ by executing either proportional, integral, or differential operation before delivering the result to memory 13, which then outputs this signal to the driving unit 7.

Idle switch 141 is activated when the throttle valve 3 remains closed, i.e., when idling drive is underway. As soon as the idle switch 141 becomes operative, the memory retention controller 142 allows the contents of memories 12 and 13 to respectively be renewed, while the memory retention controller 142 constantly renews the adjustment signals outputted from the rotation-number adjuster 62 and the air-suction adjuster 112.

Conversely, when the idler switch 141 remains inoperative, the memory retention controller 142 inhibits memories 12 and 13 from renewing, so that the memories 12 and 13 retains the adjustment signal in the condition immediately before the idle switch 141 turns into the inoperative state.

Signal outputted from memory 13 is converted into electrical signals by the driving unit 7. These electrical signals drive the air-suction control valve 8.

This valve operates itself so that it can remain open until gaining a specific aperture area corresponding to the received electrical signal. Either a solenoid valve varying its position in proportion to the input voltage or a DC-motor valve varying its position in proportion to the power-supplied duration can effectively be used for making up the air-suction control valve 8.

Certain quantity of air corresponding to the aperture area of the air-suction valve 8 flows through bypasses 91 and 92 to cause the quantity of air absorbed by the engine 1 to either increase or decrease.

In the manner mentioned above, the number of the rotation of the internal combustion engine 1 is adjusted to the objective value, and at the same time, the air-suction quantity is also adjusted to the objective value. The air-suction adjustment signal minimizes the error $\Delta Q$ when those objective values are correctly adjusted.

this is because the air-suction adjustment signal properly adjusts the error $\Delta Q$ which is present in various constituent factors such as uneven quantity of air leaked out of the throttle valve 3 at non-loaded position or variation of the quantity of leaked air during a certain service life, variation of performance characteristic due to error or temperature caused by either the error of the initial characteristic or varied characteristic after a long-term service of the air-suction control valve 8, or the dependency of the driving unit 7 on the power voltage, or the dependency of gain on the atmospheric density, etc.

Next, the rotation-number adjusting signal adjusts the objective air-suction quantity QT by minimizing error $\Delta n$ so that the number of the rotation of the engine $n_e$ can almost match the objective number of the rotation $n_r$.

This is because the rotation-number adjusting signal properly adjusts varied thermal efficiency caused by uneven loss or varied temperature in respective parts of the engine 1 or variable load typically present in automotive internal combustion engines normally generated by those fittings such as lamps and motors for example.

Next, operation of the preferred embodiment shown in the accompanying drawing is described below.

When the idle switch 141 remains inoperative (i.e., when the engine itself is not in the idling state), memories 12 and 13 are respectively held under retention, and thus, no operation is performed for adjusting the number of the rotation of the engine 1. This causes the engine 1 to abide by the control of the throttle valve 3. When the idle switch 141 is reactivated (i.e., when the engine 1 enters into the idling condition), the contents of memories 12 and 13 are delivered to the rotation-number adjuster 62 and the air-suction adjuster 112 as the initial value s for activating those adjusters so that the adjustment signal in the last idling condition can continuously be relayed. Consequently, adjusted condition becomes proper immediately after activating the idle switch 141.

When employing the system retaining the contents of memories 12 and 13 while the engine stops after turning the control power source off, since the adjusted quantity immediately before stopping the engine reflects itself when starting up the engine again, and in addition, since various factors which are variable through continuous service life such as clogging of air-suction control valve for example are preliminarily adjusted, the engine can securely gain access to satisfactory startup performances.

Anticipating that temperature at the moment of resuming the control of the number of the rotation may not always be equal to the last round of the control operation, if the adjustable quantity of the number of the rotation and the adjustable quantity of air suction compensate for the error caused by engine temperature and absorbed-air temperature, the apparatus related to the invention even allows part (for example by 50%) of memory content to reflect the initial value of the air-suction adjuster 112 and the rotation-number adjuster 62 by delivering these stored contents to those initial values of those adjusters 112 and 62.

The preferred embodiment shown in the accompanying drawing stores those data related to the adjustable quantity of the number of the rotation of the engine and the adjustable quantity of air suction in memories 12 and 13. However, if the operative speed of adjusting the air-suction quantity is so fast without requiring preliminary retention of the adjustable quantity, memory 12 may be deleted. Likewise, if there is no need of extensively adjusting the number of the rotation of the engine, due to the same reason as above, memory 13 may also be deleted.

INDUSTRIAL APPLICABILITY

As is clear from the above description, the invention provides the apparatus with the engine-rotation number adjuster and the air-suction adjuster by separating variable factors of rotation into the one which is derived from the loss in the engine and the other from means for adjusting the air-suction quantity in order that these adjusters can be operated during the idling cycle of the engine and stop their operations when the engine is not in the idling condition. Furthermore, since the apparatus related to the invention allows memory means to securely retain date related to the adjustable quantity of air-suction quantity and the adjustable quantity of the number of the rotation of the engine during the engine stops, the engine itself can instantaneously gain access to the properly-adjusted condition as soon as the control of the number of the rotation is reactivated. This in turn generates quite satisfactory startup performance characteristic.

Consequently, the apparatus for controlling the number of the rotation of the internal combustion engine embodied by the invention provides unsurpassed effect when this control system is applied to any internal combustion engine which generates a large amount of initial tolerance and variable performance characteristic during a long-term service life.

What is claimed is:

1. An apparatus for controlling the number of the rotation of an internal combustion engine comprising; a rotation-number adjuster which generates an objective air-suction quantity and an objective air-suction tube pressure of the engine in conjunction with the number of the rotation and an objective number of the rotation of the engine; an air-suction adjuster which generates adjustment signals in conjunction with the signal output from said rotation-number adjuster and the air-suction quantity and air-suction tube pressure of the engine; an air-suction control valve which increases and decreases one of said air-suction quantity and air-suction tube pressure of the engine on receipt of a signal outputted from said air-suction adjuster; and means for retaining said air-suction quantity and the number of the rotation of the engine by stopping at least one of those operations executed by said rotation-number adjuster and said air-suction adjuster when the engine is not in idling condition.

2. The apparatus for controlling the number of the rotation of an internal combustion engine as set forth in claim 1, wherein said rotation-number adjuster or air-suction adjuster is provided with constitution which allows retention of adjustable quantity when operation of either of these adjusters are stopped.

* * * * *